United States Patent [19]

Goss et al.

[11] Patent Number: 4,733,059

[45] Date of Patent: Mar. 22, 1988

[54] ELONGATED PARALLEL, CONSTANT WATTAGE HEATING CABLE

[75] Inventors: David C. Goss, San Marcos; Chandrakant M. Yagnik, Austin, both of Tex.

[73] Assignee: Thermon Manufacturing Company, San Marcos, Tex.

[21] Appl. No.: 62,783

[22] Filed: Jun. 15, 1987

[51] Int. Cl.[4] ..... H05B 3/10

[52] U.S. Cl. ..... 219/548; 219/528; 219/553; 338/22 R

[58] Field of Search ..... 219/548, 528, 553, 549; 29/611; 338/22 R, 66

[56] References Cited

U.S. PATENT DOCUMENTS

| | | | |
|---|---|---|---|
| 2,952,761 | 9/1960 | Smith-Johannsen | 219/548 |
| 3,757,086 | 9/1973 | Indoe | 219/464 |
| 3,861,029 | 1/1975 | Smith-Johansen | 29/611 |
| 4,037,083 | 7/1977 | Leavines | 219/552 |
| 4,072,848 | 2/1978 | Johnson et al. | 219/528 |
| 4,117,312 | 7/1978 | Johnson et al. | 219/548 |
| 4,304,044 | 12/1981 | Lee | 29/611 |
| 4,345,368 | 8/1982 | Goss et al. | 29/611 |
| 4,369,423 | 1/1983 | Holtzberg | 338/66 |
| 4,392,051 | 7/1983 | Goss et al. | 219/528 |
| 4,459,473 | 7/1984 | Kamath | 219/553 |
| 4,485,297 | 11/1984 | Grise et al. | 219/528 |
| 4,543,474 | 9/1985 | Horsma et al. | 219/553 |
| 4,575,620 | 3/1986 | Ishii et al. | 219/549 |
| 4,659,913 | 4/1987 | Midgley et al. | 219/549 |

OTHER PUBLICATIONS

Owens Corning Fiberglas, Fiberglas Conductive Roving, Dec. 7, 1983.

*Primary Examiner*—E. A. Goldberg
*Assistant Examiner*—M. M. Lateef
*Attorney, Agent, or Firm*—Pravel, Gambrell, Hewitt, Kimball & Krieger

[57] ABSTRACT

A parallel, zoned heating cable wherein parallel electrical conductors are spaced outwardly from a central heating element preferably formed of a fibrous material containing carbon or graphite or coated with a conductive polymer. Heat conducting dielectric members are preferably located between the heating element and the electrical conductors for improved thermal distribution of the cable. The conductors are alternately connected by splices to the electrical conductors to produce heat of a constant wattage.

27 Claims, 8 Drawing Figures

ELONGATED PARALLEL, CONSTANT WATTAGE HEATING CABLE

BACKGROUND OF THE INVENTION

1. Field of the Invention

The present invention relates to electrical heating cables that use an electrically resistive heating element in a parallel, constant wattage, zone-type construction.

2. Description of Prior Art

Flexible, elongated electrical heating cables and tapes have been used commercially for many years for heating pipes, tanks, valves, vessels, instruments and for many other applications. The heating cables prevent the freezing of fluids in pipes or equipment, and provide for maintenance of minimum process fluid temperatures as required.

Elongated, parallel heating cables may be defined as assemblies of heating elements, connected in parallel either continuously, which is classified as zoneless, or in discrete zones, classified as zoned. The output or watt density of a parallel cable is basically unchanged regardless of cable length, but is slightly affected by the voltage drop along the parallel circuits forming the power-supplying buses.

There are basically four types of flexible, elongated parallel heating cables in use today. They are:

(1) Zoneless-type, self-limiting
(2) Zone-type, self-limiting
(3) Zoneless-type, constant wattage
(4) Zone-type, constant wattage Zoneless-type, self-limiting cables are exemplified in U.S. Pat. Nos. 3,861,029; 4,072,848 and 4,459,473. These heaters are generally formed of either positive temperature coefficient (PTC) conductive polymers or semiconductive polycrystalline ceramic chips. The conductive polymers may be extruded to connect two spaced-apart parallel power supplying buses, as shown in U.S. Pat. No. 3,861,029 or may be an elongated strip or strand of conductive polymeric material that is placed in contact with the buses alternately with one bus, then the other, as shown in U.S. Pat. No. 4,459,473. The conductive polymeric elements and buses are then encased in an outer insulating jacket. The semiconductive polycrystalline ceramic heaters are formed by placing multiple ceramic chips in contact with and between two spaced-apart parallel buses at close spacing and then encasing the chips and buses in an electrical insulation as described in U.S. Pat. No. 4,072,848.

Zone-type, self-limiting heating cables are exemplified in U.S. Pat. Nos. 4,117,312 and 4,304,044. In these heaters, semiconductive polycrystalline ceramic chips are used to control or limit the power output of the heating zones that are formed by a resistive wire alloy that is spirally wrapped around two electrically insulated parallel buses and alternately connected to a point where the insulation has been removed from first one wire, then the other at prescribed distances. The chips are located in contact with the buses and the alloy wire or just in contact with the alloy wire, depending on the design. The assembly is then encased in an insulating jacket.

Zoneless-type, constant wattage heaters are exemplified by U.S. Pat. Nos. 2,952,761 and 4,485,297. These heaters typically are comprised of a heating element formed from a conductive coating of graphite or carbon dispersed throughout a non-conductive adhesive vehicle, such as an alkali-stabilized colloidal silica as described in Pat. No. 2,952,761, or a colloidal graphite ink as described in Pat. No. 4,485,297. The pattern for the conductive carbon composition is either printed or otherwise dispersed on an electrically insulating substrate that contains parallel bus strips. The substrate with the conductive carbon composition is then covered with an electrically insulating layer to provide a complete heater.

Zone-type, constant wattage heaters include heating elements generally formed of a metal alloy commonly comprised of nickel, chromium and iron and are exemplified in U.S. Pat. Nos. 3,757,086; 4,037,083, 4,345,368, and 4,392,051. In this class of heaters the metal alloy element is generally a small gauge resistance wire that is spirally wrapped around two parallel electrically insulated buses. The resistance wire makes contact on alternate buses at predetermined intervals where the electrical insulation of the buses has been removed to provide direct electrical contact for the resistance wire with the power-supplying bus. The buses with the resistant wire are then encased in an insulation jacket. U.S. Pat. Nos. 4,345,368 and 4,392,051 disclose the use of a resistance wire placed between and running parallel with the buses. An electrically conductive splice then connects the resistance wire alternately with first one bus, then the other bus. This assembly is then encased in an insulating jacket.

As can be seen in the previous discussion, the prior art parallel, constant wattage, zone-type heating cables have used a metal alloy resistance element to generate the heat produced by the cable. Previous zone-type constant wattage parallel heating cables as exemplified by U.S. Pat. Nos. 3,757,086 and 4,037,083 have used a small alloy wire spirally wrapped around two parallel buses as described earlier. Although the spiral wrapping provided fairly even temperature distribution over the surface of the heating cable, a small wire of 36–42 gauge was necessary to provide a heater with reasonable zone dimensions for standard 120 and 240 volt heating cables. This small gauge wire was rather fragile and, under certain stress induced conditions of voltage and temperature cycling, the small wire would break, rendering that particular zone inoperative.

A cable designed according to U.S. Pat. Nos. 4,345,368 and 4,392,051 reduced the stress breakage of the small gauge wire but due to the design, the heat was concentrated along the longitudinal center line of the heating cable and had poor heat distribution around the surface of the cable which caused the heating element to operate at high temperatures due to poor heat dissipation.

Where carbon elements of any type have been used, they have either been used for self-limiting or for zoneless heaters and have not had application in zone-type, constant wattage cables.

Non-metallic, conductive fibers have been used previously in automotive ignition systems as disclosed in U.S. Pat. No. 4,369,423, which systems work with voltages in excess of 20,000 and are not designed to produce heat, but rather concerns are production of minimal radio frequency noise, withstanding environment rigors and conducting sufficiently to ignite the fuel mixture.

SUMMARY OF THE INVENTION

The heating cable of the present invention has a heating element comprised of a carbon, graphite or other non-metallic, conductive filament or fiber containing material that displays stability at high temperatures, has a high tensile strength and can withstand repeated thermal cycling without exhibiting physical or electrical damage. The heating cable is formed of the non-metallic, conductive heating element which preferably has adjacent heat conducting dielectric members, running parallel to, and along each side of the heating element. Two power supplying buses run parallel to, and along the outside of the heating element and preferably outside of the heat conducting dielectric member, if used. An electrically conductive splice band alternately connects the conductive element to the power bus on opposite sides of the cable along the length of the parallel heating cable at prescribed distances. The heat conducting, dielectric members improve the heat transfer from the heating element over conventional dielectric materials which have low thermal conductivities. The improved heat transfer provides a more even heat distribution across the width of the heating cable, allowing the heating element to operate at a lower temperature for a given unit heat dissipation and reducing thermal and mechanical stresses on the heating cable.

DESCRIPTION OF THE PREFERRED EMBODIMENT

Figure 1:
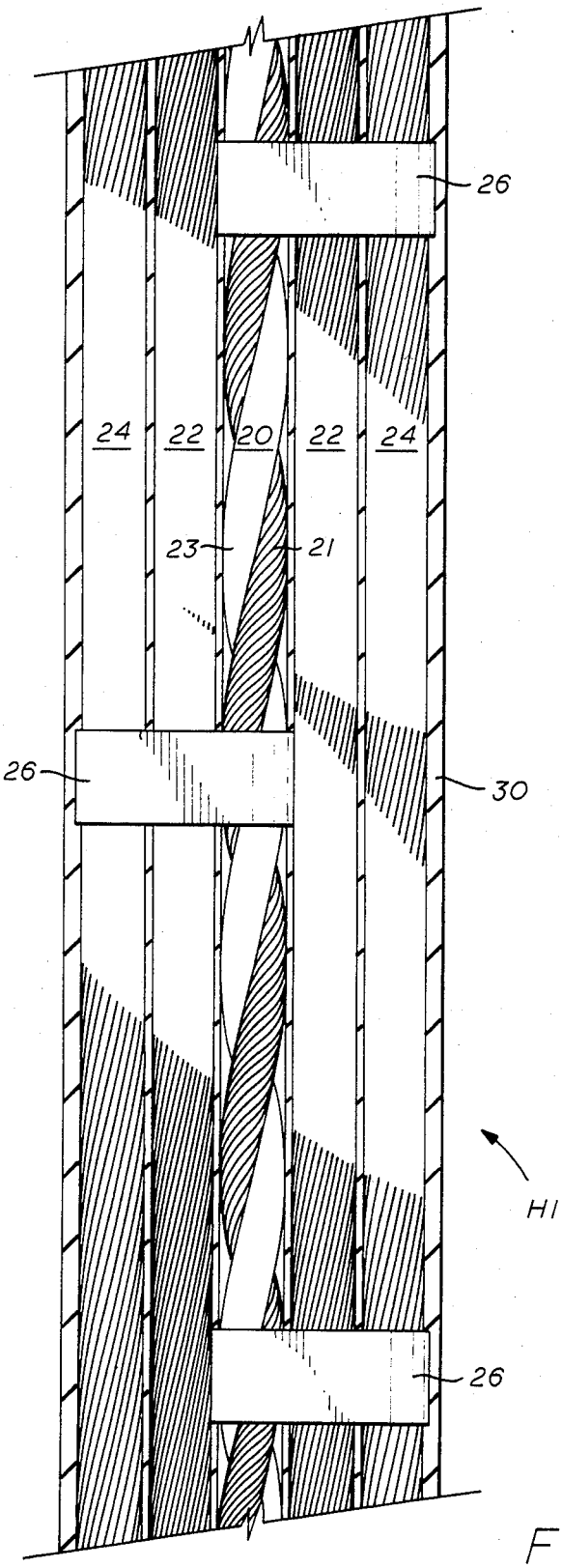
FIG. 1 is a top view in partial cross-section of a heating cable according to the present invention.

Referring to the drawings, the letter H generally designates the heating cable of the present invention with a numerical suffix indicating the specific embodiment of the cable H.

Figure 2:
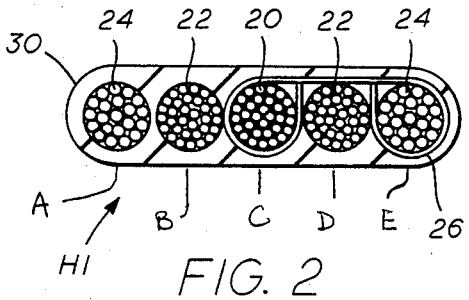
FIG. 2 is a cross-sectional end view of a heating cable according to the present invention.

FIGS. 1 and 2 illustrate a heating cable H1 constructed according to the present invention. The heating element 20 is centrally located in the cable H1 and is a non-metallic, electrically conductive fibrous material. Preferably, the heating element 20 includes a fiberglass conductive roving material comprised of multiple ends of continuous filament yarn which have been treated with a coating such as carbon or graphite to impart electrical conductivity to the material. The heating element 20 may have two components, carbonized fiberglass 21 and a filler fiberglass yarn 23 so that carbonized fiberglass 21 of the desired resistance can be used, with the filler yarn 23 providing the spacing needed to make the heating element 20 have a desired diameter. Typical graphitized fiberglass roving has a resistance of 2,000 to 6,000 ohms per foot. Many additional types of conductive carbon fiber filament materials may be used in the resistive heating element 20, such as graphitized polyacrylonitrile (PAN) or graphitized organic precursor fibers such as rayon, pitch and others.

Alternatively, the heating element 20 may be a conductive polymer strip or strand. Preferably the polymeric material is placed over a high temperature fiber filament carrier for spacing and strength. The conductive polymer may exhibit a substantially constant resistance over temperature range or may exhibit a positive temperature coefficient behavior if self-limiting action is desired. Such conductive polymers are well known to those skilled in the art.

Located adjacent to and parallel the heating element 20 are heat conducting dielectric members 22. The heat conducting members 22 are preferably formed of a high temperature fiberglass yarn that has been treated in polyvinyl acetate. The polyvinyl acetate is used as a binder to hold the filaments of the fiberglass yarn together for improved heat conduction. The yarn can be treated with the polyvinyl acetate either prior to assembly of the cable H1 or after assembly of the cable H1. Other suitable binders such as silicone varnish may be used to perform the function.

Located adjacent the dielectric members 22 and parallel to them are electrical conductors 24. The electrical conductors 24 are connected in parallel to provide a substantially constant voltage along the length of the cable H1, the voltage difference between the conductors 24 being only somewhat reduced due to the resistive effects of the electrical conductor 24. The electrical conductor is preferably stranded copper wire but can be solid copper or other good electrical conductors.

Figure 5:
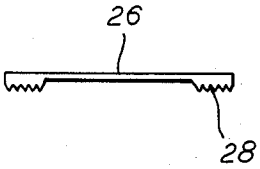
FIG. 5 is an end view of an uncompressed splice as used in a heating cable according to the present invention.

The electrical conductors 24 are electrically connected to the heating element 20 by means of a series of conducting splices 26. The conducting splices are shown in an uncrimped form in FIG. 5, including serrations 28 used to provide a positive grip into the conductor 24 and the heating element 20. The conductive splices 26 are alternately connected to the two electrical conductors 24 to provide a voltage difference across segments of the heating element 20.

This alternate arrangement of the splices 26 results in the formation of a zone-type heating cable because the heating element 20 is connected to the electric conductors 24 only at certain locations and not substantially continuously along its length. If the heating element is comprised of graphitized or carbonized fiberglass or a conductive polymer having a zero temperature coefficient, the cable H1 is a zoned, constant wattage cable. If the heating element 20 is comprised of a conductive polymer having positive temperature coefficient characteristics, the cable H1 is classified as a zoned, self-limiting cable.

The elements of the cable H1 so far discussed are assembled and then are coated with an outer insulation 30 to protect the environment from electrical shock and from the degrading effects of the environment. The insulation 30 is preferably flexible, heat conductive and does not degrade under application of heat. Typical examples of materials for the insulation 30 include insulating thermoplastic resins such as polyethylene, polytetrafluorine ethylene, polypropylene, polyvinyl chloride, mixtures thereof and other like materials.

A cable H1 producing approximately 10 watts per foot is formed by using 16 gauge copper wire formed of 19 strands of 29 gauge wire for the electrical conductors 24, fiberglass cording having a diameter of approximately 60 mils for the dielectric members 22 and fiberglass cording 23 having an approximate diameter of 30 mils wrapped with the carbonized fiberglass roving 21 having an approximate diameter of 30 mils and a resistance varying from 2000 to 6000 ohms per foot, depending on energization voltage, for the heating element 20, with the resulting cable H1 having a width of approximately 0.39 inches and a thickness of approximately 0.13 inches.

Figure 3:
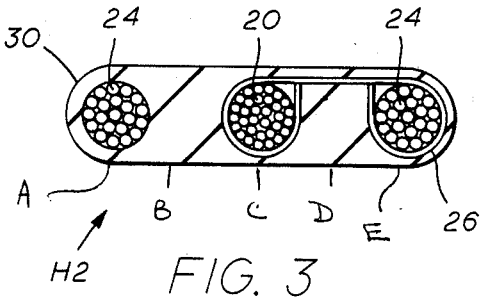
FIG. 3 is a cross-sectional end view of a heating cable according to the present invention.

FIG. 3 shows a cable H2 having the fibrous non-metallic, conductive heating element 20 but not having the heat conductive dielectric members 22. A heating cable H3 (FIG. 4) is similar to heating cable H2 except that the insulation 30 has a reduced thickness at portions between the conductors 24 and the heating element 20.

Figure 7:
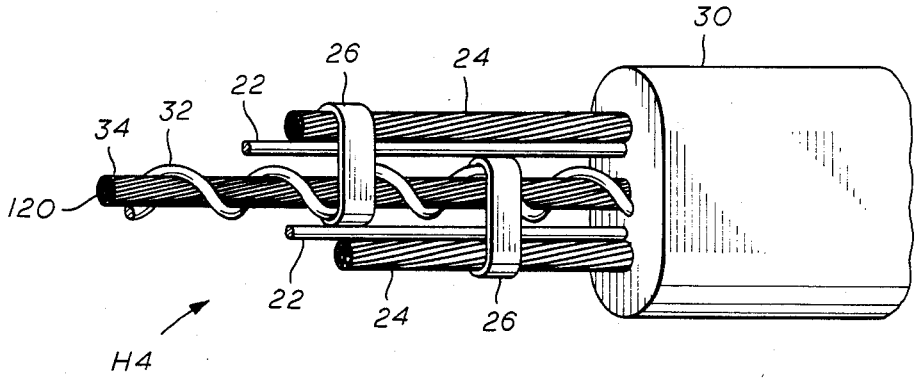
FIG. 7 is a perspective view in partial cross-section of a heating cable according to the present invention.

A heating cable H4 (FIG. 7) has a heating element 120 formed by wrapping a resistive heating wire 32 around a fibrous central core 34. The resistance wire 32 is preferably an alloy of nickel, chromium and iron but can be other alloys of nickel and chromium with aluminum or copper providing a high electrical resistivity. The splices 26 are connected between the conductors 24 and make contact with the resistance wire 32 to allow heat to be generated.

Figure 8:
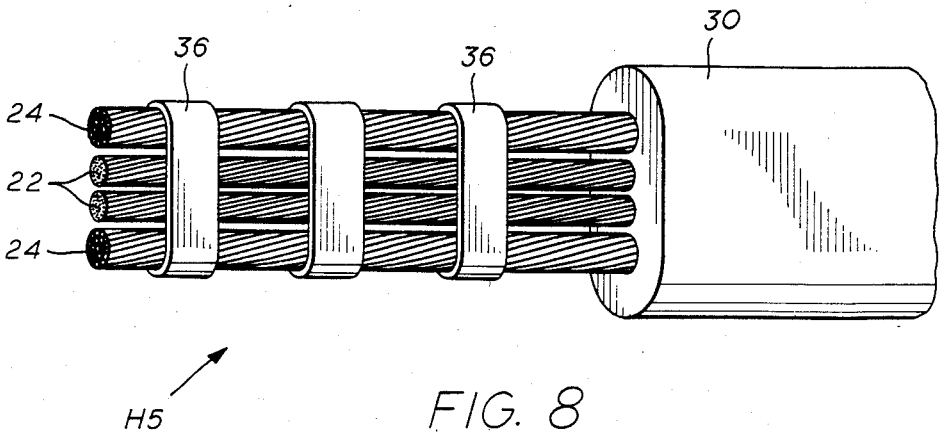
FIG. 8 is a perspective view in partial cross-section of a heating cable according to the present invention. cl

A heating cable H5 (FIG. 8) uses resistance material to form the splices 36, the resistive splices 36 then essentially forming the heating elements. The splices 36 are connected directly between the conductors 24 with no need for a central heating element. The heat conducting dielectric members 22 are located parallel to and adjacent the electrical conductors 24 to provide improved heat transfer of the heat generated by the resistive splices 36.

EXAMPLE 1—TEMPERATURE DISTRIBUTION

Figure 4:
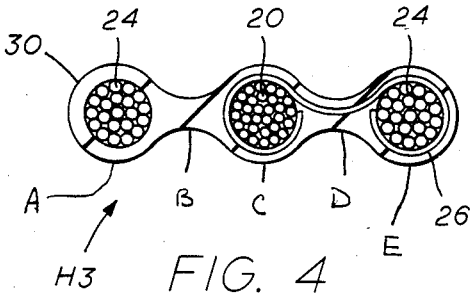
FIG. 4 is a cross-sectional end view of a heating cable according to the present invention.

Heating cables according to H1, H2 and H3 were designed to produce approximately 10 watts per foot. Three samples of each were prepared and their temperature distribution and power consumption measured. Results are shown in the following table where locations A, B, C, D, and E are shown in FIGS. 2–4; $T_{ave.}$ is the average temperature in degrees Fahrenheit at all points except point C; $\Delta T$ is the temperature differential between $T_{ave.}$ and the temperature at location C for each samples; $Tc_{ave.}$ is the average temperature at the heating element location C for the three samples of each cable; and $\Delta T_{ave.}$ is the average $\Delta T$ for all three samples of each cable.

| SAMPLE TYPE | WATTS/FT. | TEMPERATURE AT LOCATION A °F. | B °F. | C °F. | D °F. | E °F. | $T_{ave.}$ °F. | $\Delta T$ °F. | $Tc_{ave.}$ °F. | $\Delta T_{ave.}$ °F. |
|---|---|---|---|---|---|---|---|---|---|---|
| FIGS. 1 | 10.13 | 195 | 215 | 240 | 210 | 195 | 204 | 36 | 237 | 28 |
| and 2 | 10.24 | 210 | 225 | 250 | 220 | 195 | 213 | 38 | | |
| | 10.04 | 205 | 220 | 220 | 210 | 200 | 209 | 11 | | |
| FIG. 3 | 9.94 | 165 | 200 | 290 | 195 | 170 | 183 | 108 | 278 | 93 |
| | 9.97 | 175 | 225 | 295 | 195 | 170 | 191 | 104 | | |
| | 10.09 | 185 | 200 | 250 | 185 | 160 | 183 | 68 | | |
| FIG. 4 | 10.29 | 165 | 150 | 285 | 153 | 165 | 158 | 127 | 303 | 137 |
| | 10.00 | 160 | 165 | 320 | 165 | 190 | 170 | 150 | | |
| | 10.05 | 150 | 200 | 305 | 185 | 150 | 171 | 134 | | |

As can be seen, the cable H1 (FIGS. 1 and 2) exhibits a more even temperature distribution over the surface of the heating cable than that of cables H2 and H3. It can also be seen that the heating element 20 operated at a significantly lower temperature in heating cable H1 as compared to heating cables H2 and H3 for an equivalent unit power level.

EXAMLE 2—TEMPERATURE CYCLING

Figure 6:
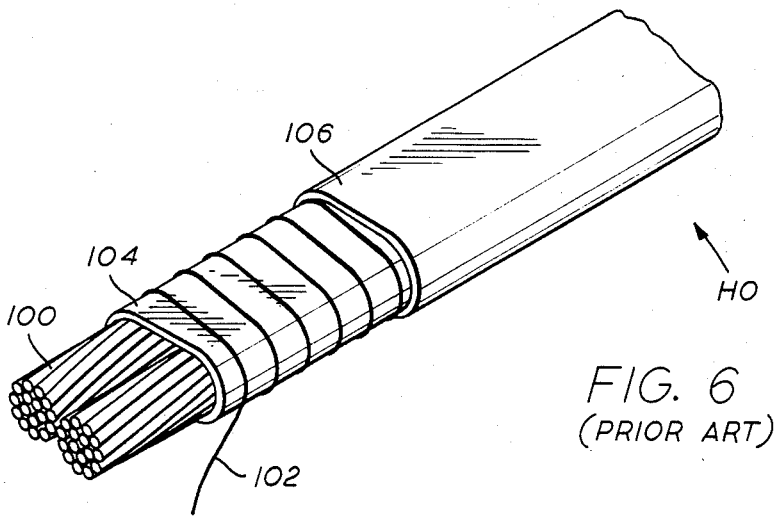
FIG. 6 (PRIOR ART)
FIG. 6 is a perspective view of a heating cable according to the prior art.

Cables constructed according to heating cable H1 were developed to produce 10 watts per foot on 120 and 240 volts. Additionally, a heating cable H0 according to the prior art as shown in FIG. 6 having electrical conductors 100, resistive wire 102 located over insulation 104 and outer insulation 106 was constructed. The samples of the prior art cables were also constructed to produce 10 watts per foot at 120 and 240 volts. For temperature and stress testing, samples of both the prior art and the present invention cables H0 and H1 were installed in test fixtures operating at 240 volts in a first oven and 120 volts in a second oven. The ovens were adjusted to cycle from 125° F. to 250° F. to perform a thermal stress test on the energized cables.

The prior art heating cable H0 energized at 240 volts failed after 162 temperature cycles while the heating cable H1 had completed 780 temperature cycles and had not failed. The heating cable H0 operating in the 120 volts text fixture failed after 570 temperature cycles. Heating cable H1 in that same oven and operating at the same voltage had completed at least 3,640 cycles and had not failed as of that time.

Therefore it is clear that heating cables designed according to the present invention can improve the temperature distribution and reduce the thermal stress induced in the cables.

It will be understood that because the heat is generated initially in the heating element 20, the cable may be selectively formed or cut into any desired length while still retaining the same watts per foot capability for the selected length.

The foregoing disclosure and description of the invention are illustrative and explanatory thereof, and various changes in the size, shape and materials as well as in the details of the illustrated construction may be made without departing from the spirit of the invention, all such changes being contemplated to fall within the scope of the appended claims.

We claim:

1. An electrical heating cable, comprising:

first and second electrical conductor means extending substantially parallel to and spaced from each other along the length of the cable for carrying electrical current;

heating means for generating heat comprising a non-metallic, electrically conductive material arranged substantially parallel to said electrical conductor means;

means for alternately electrically connecting said heating means to said first and second electrical conductor means to establish an alternating series of electrical connections between said first electrical conductor means and said heating means and said second electrical conductor means and said heating means; and protective cover encasing said electrical conductor means and said heating means.

2. The heating cable of claim 1, wherein said heating means comprises fiberglass roving coated with carbon to produce electrical conductivity.

3. The heating cable of claim 1, wherein said heating means is graphitized polyacrylonitrile.

4. The electrical heating cable of claim 1, wherein said heating means comprises fibrous filaments coated with a conductive polymer.

5. The heating cable of claim 4, wherein said conductive polymer has a substantially constant electrical resistance over temperature.

6. The heating cable of claim 4, wherein said conductive polymer has a positive temperature coefficient.

7. The heating cable of claim 1 further comprising means for spacing said heating means and said conductor means in a spaced apart substantially parallel relationship.

8. The heating cable of claim 1, wherein said connecting means comprises deformable, electrically conductive splices.

9. The heating cable of claim 8, wherein said electrically conductive splices have deformable end surfaces which are crimped about said electrical conductor means and said heating means.

10. The heating cable of claim 9, wherein the deformable end surfaces of said electrically conductive splices have projections for gripping said electrical conductor means and said heating means.

11. The heating cable of claim 1, further comprising:

first and second heat conducting dielectric means for conducting heat from said heating means positioned adjacent said heating means, said first heat conducting dielectric means positioned between said first electrical conductor means and said heating means and said second heat conducting dielectric means positioned between said second electrical conductor means and said heating means.

12. The heating cable of claim 11, wherein said dielectric means comprises high temperature fiberglass yarn and a binder.

13. The heating cable of claim 12, wherein said binder comprises polyvinyl acetate.

14. An electrical heating cable, comprising:

first and second electrical conductor means extending substantially parallel to and spaced from each other along the length of the cable for carrying electrical current;

heating means for generating heat, said means being connected to said first and second electrical conductor means;

heat conducting dielectric means for conducting heat from said heating means, positioned adjacent said heating means and between said first and second electrical conductor means; and protective cover encasing said electrical conductor means, said heating means and said dielectric means.

15. The heating cable of claim 14, wherein said heating means comprises:

electrically resistive heating means for generating heat arranged substantially parallel to said electrical conductor means; and means for alternately electrically connecting said resistive heating means to said electrical conductor means to establish an alternating series of electrical connections on opposite sides of the cable between said first electrical conductor means and said resistive heating means and said second electrical conductor means and said resistive heating means; and wherein said heat conducting dielectric means comprises:

first and second individual heat conducting dielectric means for conducting heat from said heating means positioned adjacent said heating means, said first individual heat conducting dielectric means positioned between said first electrical conductor means and said resistive heating means and said second individual heat conducting dielectric means positioned between said first electrical conductor means and said resistive heating means.

16. The heating cable of claim 15, wherein said heating means comprises resistive heating wire.

17. The heating cable of claim 15, wherein said heating means comprises resistive heating wire helically wound about an electrically nonconductive core.

18. The heating cable of claim 15, wherein said heating means comprises non-metallic, electrically conductive material including fibrous material.

19. The heating cable according to claim 15, wherein said connecting means comprises a plurality of deformable, electrically conductive splices.

20. The heating cable according to claim 19, wherein said splices have deformable end surfaces which are crimped about said electrical conductor means and said heating means.

21. The heating cable according to claim 20, wherein said deformable end surfaces have projections for gripping said electrical conductor means and said heating means.

22. The heating cable of claim 14, wherein said dielectric means comprises high temperature fiberglass yarn and a binder.

23. The heating cable of claim 22, wherein said binder comprises polyvinyl acetate.

24. The heating cable of claim 14, wherein said heating means comprises:

high resistance, electrically conductive material that generates heat upon the passage of electrical current, said material being electrically connected to both said first and second electrical conductor means.

25. The heating cable according to claim 24, wherein said high resistance material comprises a plurality of deformable electrically conductive splices.

26. The heating cable according to claim 25, wherein said splices have deformable end surfaces which are crimped about said electrical conductor means.

27. The heating cable according to claim 26, wherein said deformable end surfaces have projections for gripping said electrical conductor means.

* * * * *